US006023870A

United States Patent [19]

McGarrah

[11] Patent Number: 6,023,870

[45] Date of Patent: Feb. 15, 2000

[54] VENDOR WITH CHANGEABLE GRAPHICS AND METHOD THEREFOR

[75] Inventor: Robert G. McGarrah, Brookfield, Conn.

[73] Assignee: Pepsico Inc., Purchase, N.Y.

[21] Appl. No.: 08/746,269

[22] Filed: Nov. 8, 1996

Related U.S. Application Data

[63] Continuation-in-part of application No. 08/309,719, Sep. 21, 1994, Pat. No. 5,598,655.

[51] Int. Cl.[7] ..... G09F 7/02

[52] U.S. Cl. ..... 40/611; 40/594

[58] Field of Search ..... 40/611, 594, 595, 40/630, 618, 575

[56] References Cited

U.S. PATENT DOCUMENTS

| | | | |
|---|---|---|---|
| D. 290,269 | 6/1987 | McGarrah . | |
| D. 290,270 | 6/1987 | McGarrah . | |
| D. 290,271 | 6/1987 | McGarrah . | |
| D. 290,272 | 6/1987 | McGarrah . | |
| D. 314,795 | 2/1991 | McGarrah . | |
| D. 314,796 | 2/1991 | McGarrah . | |
| 2,586,039 | 2/1952 | Heggedal | 40/594 |
| 4,741,119 | 5/1988 | Baryla | 40/594 |
| 4,940,622 | 7/1990 | Leavitt, Sr. et al. | 40/594 X |
| 4,992,131 | 2/1991 | Connell | 40/594 X |
| 5,255,968 | 10/1993 | Craven | 40/611 X |
| 5,465,774 | 11/1995 | Smith | 160/90 |

FOREIGN PATENT DOCUMENTS

| | | | |
|---|---|---|---|
| 1558538 | 1/1969 | France | 40/594 |
| 698584 | 10/1953 | United Kingdom | 40/594 |
| 2117547 | 10/1983 | United Kingdom | 40/594 |

*Primary Examiner*—Cassandra H. Davis
*Attorney, Agent, or Firm*—Finnegan, Henderson, Farabow, Garrett & Dunner, L.L.P.

[57] ABSTRACT

Apparatus for displaying and replacing graphic sheets includes a clear display panel of a vending machine ("vendor"), a mechanism for controlling access to the reverse side of the display panel, and thereon a plurality of removably adhered graphics sheets, illustratively a graphics frame and a graphics sheet removably adhered by static cling and clinging to the reverse side of the clear display panel within the graphics frame. The graphics frame and the graphics sheet include a plurality of cut-out areas or overlay areas, any of which is changeable to update point-of-sale information and to provide a variety of changeable messages, color, and other visual effects.

11 Claims, 5 Drawing Sheets

VENDOR WITH CHANGEABLE GRAPHICS AND METHOD THEREFOR

CROSS-REFERENCES TO RELATED APPLICATIONS

This application is a continuation in part of application Ser. No. 08/309,719, filed Sep. 21, 1994 now U.S. Pat. No. 5,598,655.

BACKGROUND OF THE INVENTION

1. Field of the Invention

The present invention relates to a method and apparatus for displaying and changing advertising or marketing graphics at points of sale, such as vending machines, and particularly for displaying and changing advertising or marketing graphics at a transparent display surface of a vending machine.

2. Description of the Related Art

Product providers employing vending machines (hereinafter, "vendors") as a sales outlet experience increasing costs as a result of the need to change graphic images on the vendors to coincide with the introduction of new products, new logos, new advertising slogans, and package designs for existing products. For example, vendors, such as soft drink vendors, yield reliable service for seven to ten years. The front panel on those vendors is frequently used as a display board for presenting the product in some fashion and for communicating advertising or promotional messages (collectively, "product graphics") to promote sales of products. For example, marketing research shows that, for reasons involving appetite appeal and impulse purchasing, a soft drink product sells best from a vendor if a package of the product on ice is displayed in graphic form on the machine.

The limited versatility of fixed-graphic machines becomes apparent when a new brand of soft drink or a new package design is to be displayed on the vendor front. The front is typically a durable tough plastic that extends most of the height and width of the machine. The product graphics are typically screen-painted ("screened" or "silk-screened") onto a surface of the panel, such as the back surface if the plastic is otherwise clear. Replacing the product graphics may cost $75 to $150, including labor and other removal costs, as well as labor and other installation costs for the new product graphics. When adhesive attachment of sign face material is also used, labor and other costs are increased because of the problems of adhesive removal over any practical-size display area. If the plastic panel itself requires replacement, the cost is still greater.

Additionally, a limited number of products (usually 1 or 2) can be advantageously displayed (visible at a distance) at one time, even though the number of products in the vendor can be much greater. Many sales may be lost as consumers are disappointed by assuming the vendor does not contain a new product or another product not displayed.

It would be desirable to solve one or more of these problems.

SUMMARY OF THE INVENTION

According to the invention, it has been recognized that both problems can be solved by an apparatus and a method disclosed hereinafter. The apparatus for displaying and replacing product graphics includes a clear display panel, a mechanism for controlling access to the reverse side of the panel, and a graphics frame affixed to the display panel to indicate the position on the panel reverse side for placement of a graphics sheet. Importantly, the apparatus also includes a graphics sheet removably adhered to the reverse side of the clear display panel within the graphics frame.

In the preferred embodiments, the apparatus is operatively connected to a device for graphics display and the graphics sheet comprises a material capable of static cling and removably adhered to the panel reverse side by static cling.

As used herein, the term "static cling" means the phenomenon, regardless of physical origin, that causes a thin flexible sheet to adhere to a solid surface without an intervening adhesive medium. Specifically, the term excludes use of intervening media that are conventional adhesives. Moreover, static cling also excludes the relatively new adhesives, such as tacky adhesives (partial adhesives or reusable adhesives), that permit release of a bond between surfaces.

The use of static cling in the preferred embodiments makes possible simple, quickly changeable, and inexpensive product graphics. Frequent changes of product graphics are an asset rather than a liability because the full range of products in a vending machine ("vendor") can be displayed in any rotation. Product graphics may be removed and changed to a new graphic design with ease of removal and installment and at low cost at the first opportunity of the service technician. The marketing needs for new product introductions and the communication of new advertising messages are easily met. Moreover, the product graphics are protected from vandalism.

In a further preferred embodiment of the invention, the graphics frame on the panel reverse side comprises a material capable of static cling and removably adhered by static cling to the panel reverse side surrounding the position for placement of the graphics sheet.

According to one aspect of this preferred embodiment, the apparatus includes the products graphics sheet and the graphics frame together comprising a plurality of graphics sections, which advantageously are applicable in a variety of sizes, shapes, and colors to provide an expanded variety of informative, motivating, and instructional messages.

Further, the product graphics sheet in a specific implementation of the invention includes cut-out areas for graphics components, with respect to which the product graphics sheet becomes an inner graphics frame within the graphics frame. This apparatus comprises an arrangement whereby the product graphics may be changed piece-meal.

A further specific implementation of the invention provides selective overlap of translucent product graphics sheet materials such that neither of two overlapped sheet materials can be said to be a graphics frame with respect to the other, but rather each is a coordinate interactive component of the message of the apparatus.

In a less preferred embodiment, the product graphics sheet is removably adhered to the panel reverse side by a tacky adhesive.

According to a different aspect of the invention, a novel method for presenting product graphics is achieved. The method for displaying product graphics at a device includes providing on a clear display panel associated with the device a protected reverse-side display surface, providing controlled access to said display surface, and removably adhering a graphics sheet and a graphics frame on said display surface. In a preferred method of the invention, the step of removably adhering employs adhering by static cling.

In a further, preferred method of the invention, the providing step includes removably adhering the graphics frame, comprising a sheet of material with a central cut-out, to the panel reverse side. In a preferred implementation of this preferred method, the step of removably adhering the graphics frame employs adhering the graphic frame by static cling.

Further, in a specific implementation, the foregoing method of the invention includes cutting out areas of the product graphics sheet for graphics components, with respect to which the product graphics sheet becomes an inner graphics frame within the graphics frame. This method further includes steps of changing the product graphics piece-meal, and also includes cutting out areas within a sufficiently wide graphic frame to accommodate graphics components.

A further specific implementation of this method of the invention provides selective overlapping translucent product graphics sheet materials to produce a display of varying sizes, shapes, and colors involving either or both of the product graphics sheet and the graphics frame as a coordinate interaction of the overlaid translucent materials.

Additional features and advantages of the invention will be set forth in part in the description which follows, and in part will be obvious from the description, or may be learned by practice of the invention. The advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate preferred embodiments of the apparatus and method according to the invention and, together with the description, serve to explain the principles of the invention.

DESCRIPTION OF THE PREFERRED EMBODIMENT

Figure 2:
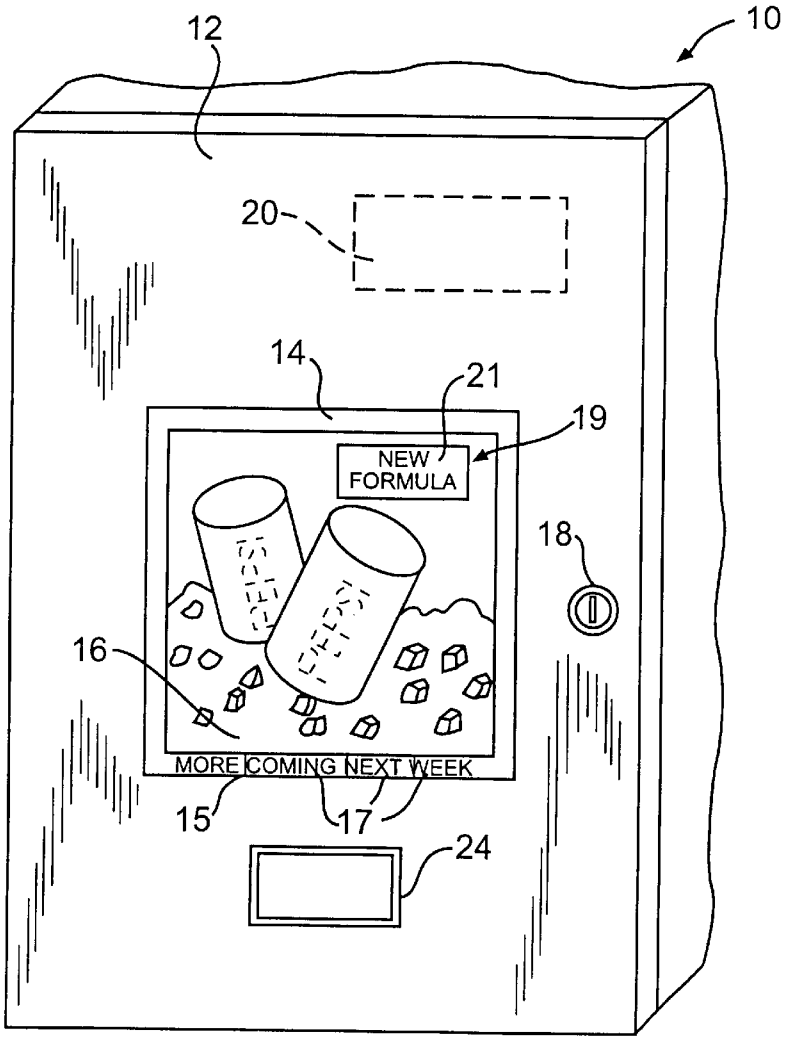
FIG. 2 is a front elevation of the panel of FIG. 1 with a product graphics sheet adhered by static cling.

Reference will now be made in detail to a preferred embodiment of the invention, an example of which is illustrated in the accompanying drawings. Wherever possible, the same reference numbers will be used throughout the drawings to refer to the same or like parts.

In accordance with the present invention, a clear display panel is provided having front and reverse sides and a graphics frame affixed to the panel to indicate a placement position on the panel reverse side for a product graphics sheet. Further, means are provided for controlling access to the reverse side of the display panel. A product graphics sheet is removably adhered to the reverse side of the display panel within the graphics frame by static cling.

Advantageously, the graphics frame is also removably adhered by static cling and is as replaceable and adaptable as the product graphics sheet itself. Adaptability is further increased by selective cut-outs and overlays.

In the illustrative embodiment of FIG. 1, a vending machine 10 (hereinafter called vendor 10) includes a clear front panel 12, for example, of LEXAN® (a trademark of the General Electric Company) resin having a graphics frame 14. LEXAN® resin is a polycarbonate resin sheet material. The panel 12 includes a lock 18 at one edge and hinges (not shown) at the opposite edge to allow access to the interior of vendor 10 and access to the reverse side of panel 12. The edges of panel 12 are preferably mounted in a strong panel frame (not shown) of metal or heavy vinyl, the panel 12 and panel frame being securely bolted to a door of vendor 10 or securely joined to the hinges and to elements of lock 18.

At least the area within graphics frame 14 of display panel 12 is preferably illuminated from within vendor 10 by a backlighting mechanism 20 (shown schematically by dotted lines in FIG. 1) While a back lighted, clear display panel 12 is readily provided on the front of vendor 10, it could in principle be provided on any other lateral side of vendor 10. See the description of FIG. 5, below. Steps would then be taken to ensure that the side of vendor 10 having such a display panel is visible to the consuming public. The principles of the invention could also be applied to marketing graphics media other than vendors. Clear display panel 12 could alternatively be composed of other rigid materials such as other polycarbonate materials. It could also be glass, preferably impact resistant tempered safety glass.

Figure 4:
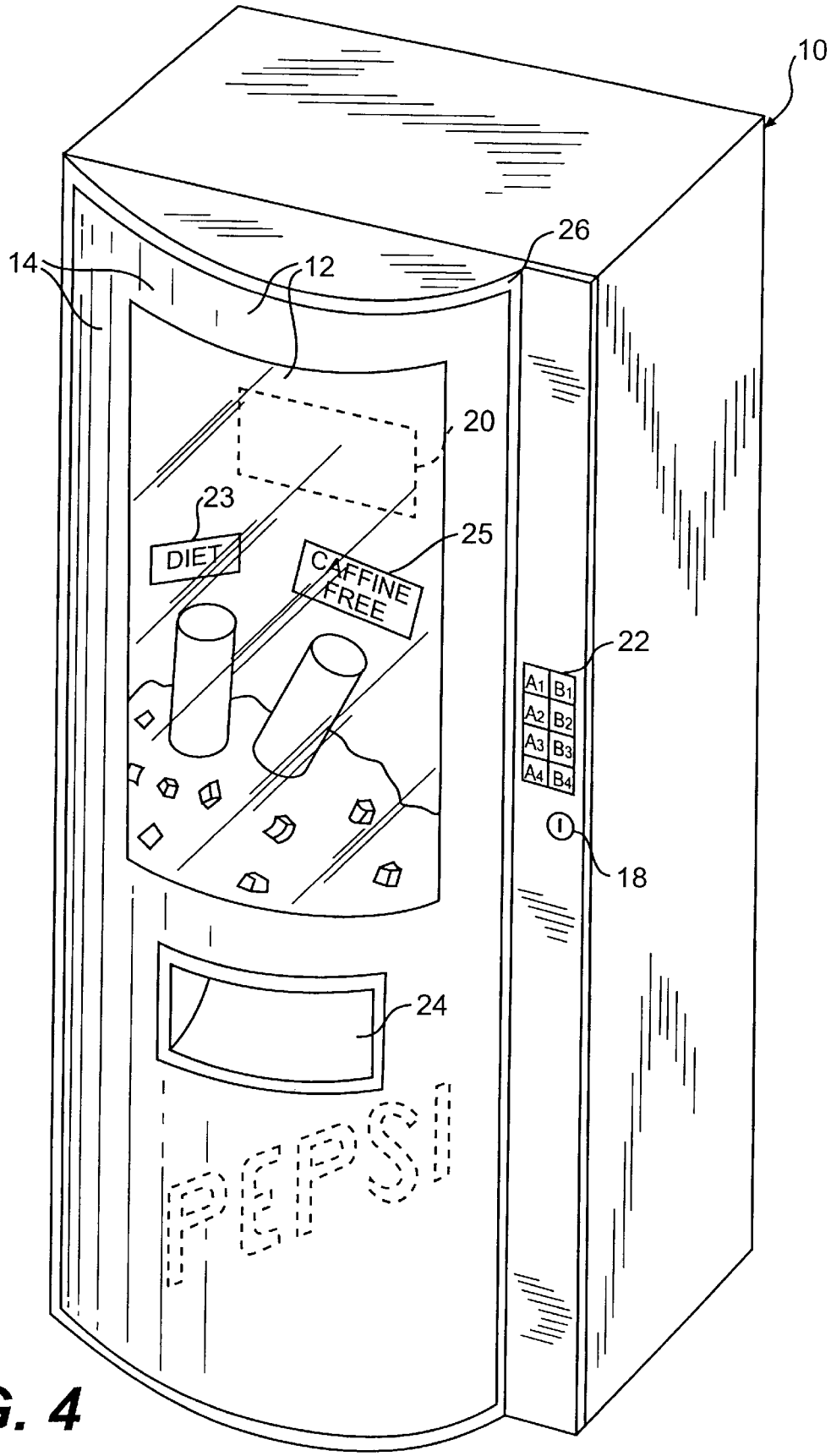
FIG. 4 is a perspective view of a preferred embodiment of the invention.

While graphics frame 14 is shown with relatively limited width, it is frequently advantageous to allow it to extend all the way to the panel edge, in any selected respective direction, or in several or all directions, as shown in FIG. 4. In FIG. 1, graphics frame 14 is a painted frame or border screened ("silk-screened") on the reverse surface of clear display panel 12. In that form graphics frame 14 is sufficiently durable to withstand incidental contact by an agent's hands, for example, in changing the product graphics sheet within the frame, as well as to withstand low level vandalism (defacing such as by scratching).

Nevertheless, graphics frame 14 also comprises material capable of static cling and provided in one or more sections. In that implementation, its composition is essentially similar to that. of product graphics sheet 16, described hereinafter. One or more of its sections, e.g., see its bottom edge in FIG. 2, provides an informational message such as "LOOK HERE FOR MORE DETAILS COMING NEXT WEEK", or other message of choice. The message could be printed on the material of graphics frame 14, or could be provided by any of the alternatives described hereinafter, e.g., inserts or overlays. Illustratively, the lower strip 15 of graphics fame 14 includes four cut-out areas 17, in respective ones of which different static cling material inserts are provided, each bearing one of the words.

In FIG. 2, clinging product graphics sheet 16 has been adhered by static cling to the area within the frame 14 on the reverse side of display panel 12. Illustratively, the edges of product graphics sheet 16 abut the inner edges of graphics frame 14 edge-to edge. Some overlap is feasible but is not necessary according to the preferred method of the invention, as described hereinafter. Product graphics sheet shows, for example, a package of soft drink in a bed of ice. In general, product graphics sheet 16 may be a flexible thin, tough sheet imprinted with logos, designs, or text; it is selected to be removed by pulling, without tearing, from the inner surface of display panel 12, once the latter is unlocked and opened. Thus, it may be easily exchanged with other flexible sheets to acquaint a consumer with the full range of products in vendor 10.

More specifically, product graphics sheet 16 may be a flexible polymer sheet, such as a vinyl sheet, bearing artwork and stored with a suitable wax-paper or foil-type sheet (not shown) protecting its front surface. For installation, the flexible polymer sheet 16 and the protecting sheet are separable by grasping each between a thumb and forefinger and pulling against the force of attraction between the sheets. Alternatively, product graphics sheet may be composed of an organic or composite material that resists tearing and possesses static cling properties.

Further, in FIG. 2, product graphics sheet may include a cutout area 19 in which a static cling insert portion 21 is emplaced. Static cling insert portion 21 illustratively includes a changeable advertising slogan, e.g., "NEW IMPROVED TASTE" or another message suitable to the changeable display in which it is inserted.

Further, in the preferred embodiment of FIG. 4, clear display panel 12 is illustratively flexed outward (bowed) about a vertical. axis by a corresponding conformation of the top and bottom portions of its mounting frame 26 and adjoining portions of the door of vendor 10. In this configuration, when clear display panel 12, is LEXAN®, the material exhibits enhanced resistance to frontal impact. Product graphics sheet 16, employing static cling, easily conforms to, and clings to, the interior of the curved clear display panel 12.

The method of the invention may be explained by reference to FIG. 3. As stated previously, the display apparatus provided in accordance with the present invention includes a clear display panel, such as panel 12, with a protected reverse-side display surface having a graphics frame, such as frame 14. Broadly the method includes providing controlled access to the display surface and removably adhering the product graphics sheet 16 within the graphics frame by static cling.

Figure 3:
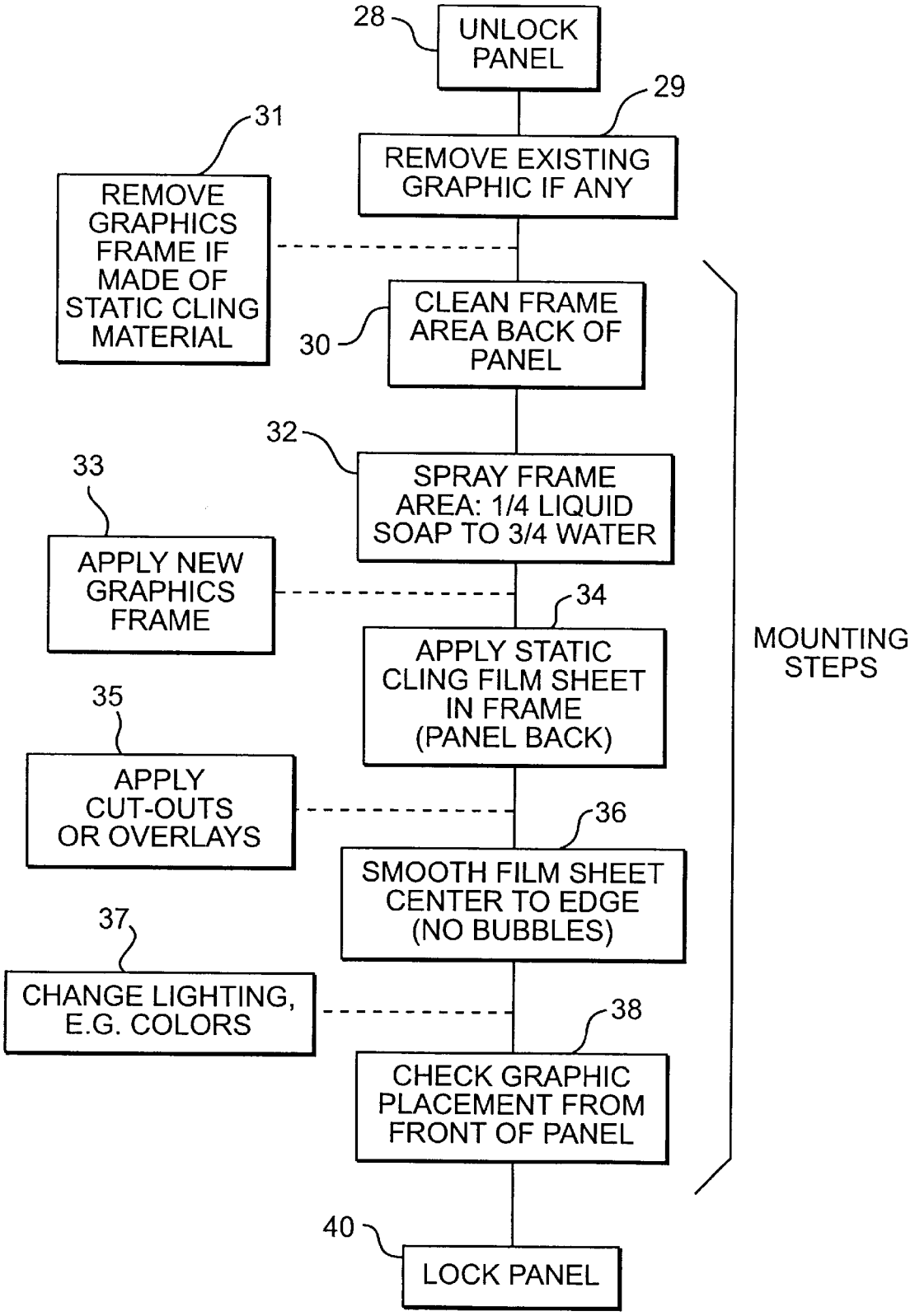
FIG. 3 is a flow chart of a detailed method according to the preferred embodiment of the invention.

In the detailed method depicted in FIG. 3, the first step 28 is to gain access to the display surface of the panel. In the disclosed embodiments, the display panel 12 with the entire access door of vendor 10 is unlocked from the frame of vendor 10.

The next step 29 prepares the vendor front for the following steps 30–38 of removably adhering the product graphics by static cling within the graphics frame on the reverse-side display surface of clear display panel 12. As embodied herein, after the display panel 12 is unlocked and opened, an existing product graphics sheet 16, if present, is removed by grasping a corner or an edge of the film sheet next to frame 14 and pulling it from the reverse surface of panel 12 against the force of the static cling.

If graphics frame 14 is also of static cling material, it may also be removed for replacement, as shown at optional step 31. Graphics frame 14 need not be replaced as often as product graphics sheet 16.

The clear area within frame 14 is then cleaned and dried, or checked to assure that it is clean and dry, as indicated in step 30.

Next, static cling installation and adherence are provided for a new product graphics sheet 16 and/or graphics frame 14, illustratively by spraying with a liquid solution, as indicated in step 32. As an example, for a vinyl product graphics sheet 16, liquid soap may be mixed with water to provide a ¼-to-¾ soap to water solution. The mixture proportions are typical and are not critical. In many instances, sufficient static cling will result even without the spraying step. However, in at least such instances, edge-to-edge adherence of product graphics sheet 16 within graphics frame 14 is made easier by lubricity provided by the solution. That is, product graphics sheet 16 may be slid enough on the panel reverse surface to achieve the desired position.

At optional step 33, a new graphics frame 14 is applied, if needed.

At step 34, the vinyl product graphics sheet 16 is applied to the reverse surface of panel 12 within frame 14, with its front surface contacting the reverse surface of panel 12.

At optional step 35, any overlays for product graphics sheet 16 or graphics frame 14 are applied, as will become clearer from the description of FIG. 5, below. Further, any inserts for cut-out areas are applied. Compare insert 21 for cut-out area 19 of FIG. 2.

The vinyl product graphics sheet 16 is then smoothed into place, for example, by hand or by using a smoothing tool, such as a squeegee, with motions from center to edge to remove any residual moisture and all air bubbles, as depicted in step 36.

In optional step 37, the backlighting of the display may be changed, e.g., by changing its color.

As shown at step 38, the placement of flexible film sheet 16 within frame 14 should be checked by viewing it from the front, and then panel 12 secured, at step 40, by locking it.

Some general considerations for both the apparatus and method of the invention may be taken into account. While not essential in all instances, it is certainly preferred that the advertising message on product graphics sheet 16 be viewable by a potential customer from a distance. Thus, in one variant, a panel 12 extends from the top of vendor 10 to the floor. Product selection buttons and even a product dispensing slot such as 22 and 24, respectively, in FIG. 4, as well as coin-handling and discharge openings and a cancel button (not shown), may be offset on vendor 10 to avoid interference with the display of product graphics sheet 16. Preferably, the product selection buttons are made square to minimize their area and still provide adequate product identification. Alternatively, any of or all of these buttons and openings may penetrate clear display panel 12 and have a sealed frame junction with clear display panel 12, as shown for product delivery slot 24.

In addition, FIG. 4 provides further examples of possible overlays or inserts into cut-out areas. Thus, the informational messages "DIET" 23 or "CAFFEINE-FREE" 25 in FIG. 4 may be provided either as overlays or inserts into cut-out areas. In either case, messages 23 and 25 are illustratively imprinted on pieces of translucent static cling materials.

Figure 5:
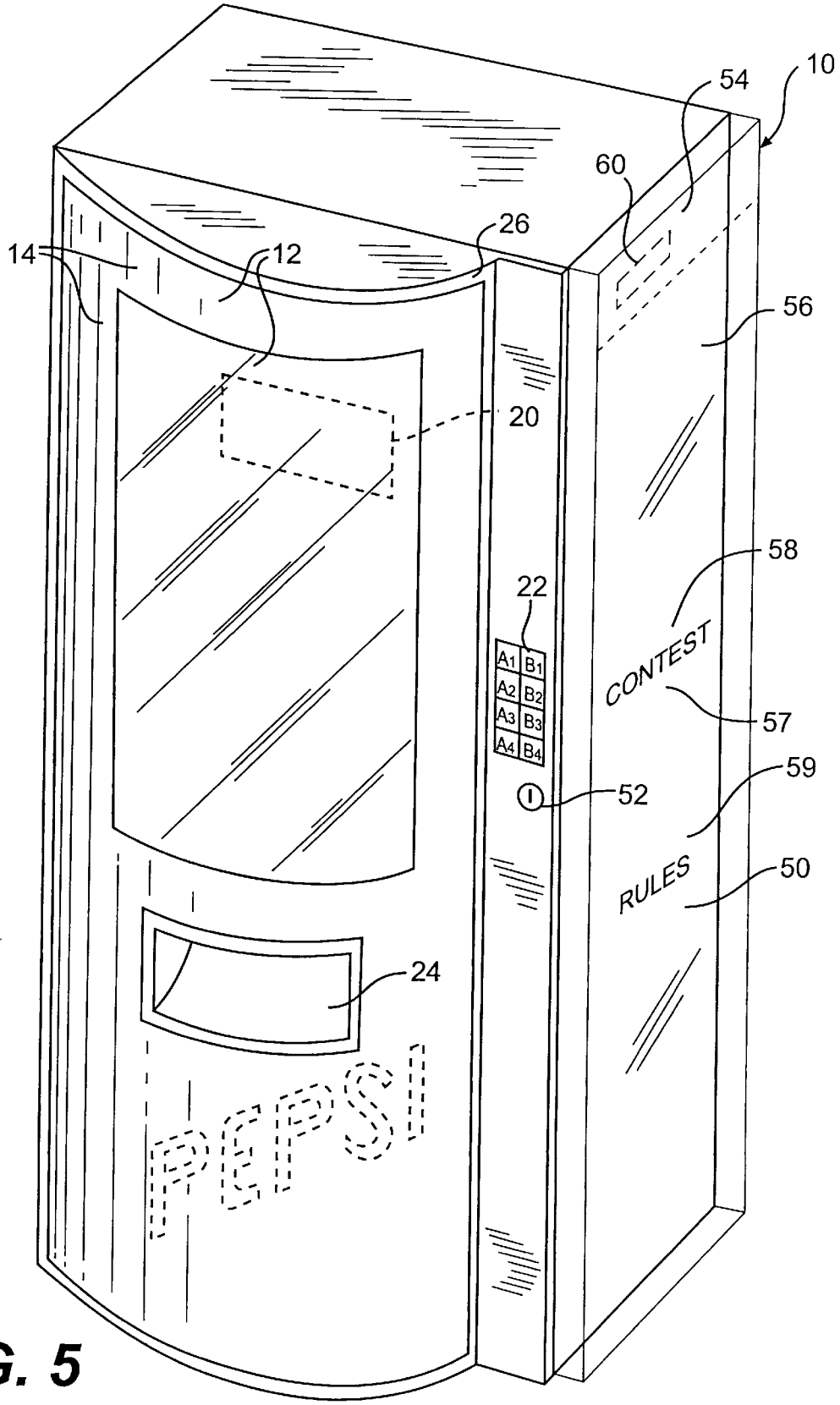
FIG. 5 is a perspective view of an alternative embodiment of the invention with a clear side panel and a common lock for front and side panels.

In FIG. 5, a modification of the embodiment of FIG. 4 is illustrated. This embodiment has both a clear front panel 12 and a clear side panel 50, each of which is used for changeable display purposes according to the invention. It is not necessary for side panel 50 to provide access to the interior of the vendor, but backlighting means 60 is desirable. Illustratively panels 12 and 50 are served by a common lock 52, but have separate hinges.

Decorative color effects are provided, e.g., by yellow overlay 54 and blue overlay 56 on large-area changeable display graphics sheet 58, which is removably adhered by static cling to the reverse side of clear side panel 50. Graphics sheet 58 illustratively completely covers the reverse surface of clear side panel 50. In the area where yellow and blue overlays 54 and 56 overlie one on the other, a green color results from well known combination (subtractive) color effects. Orange color can be generated with red and yellow overlays in a similar manner.

Overlays 54 and 56 are also removably adhered by static cling, so that the color effects can be changed from time to time. Note that where the overlay principle is used, it is relatively unimportant which of the static cling sheets 54, 56 and 58 is adhered first, the first being removably adhered to the inside of the clear side panel 50.

While graphics sheets such as graphics sheet 58 have heretofore been referred to as 'product graphics sheets', the message or information thereon need not relate to products. It could. for instance, relate to a contest that any passerby or a customer could enter. The casual reader of this information on the side panel would not interfere with the use of the vendor by a customer.

In addition to accommodating overlays 54 and 56, large-area graphics sheet illustratively has a plurality of cut-out areas in which the messages mentioned above are inserted as separately removably adhered elements. For example, the messages "CONTEST" and "RULES" are provided by such elements 57 and 59.

Moreover, the product selection buttons 22 are illustratively of clear plastic, to the reverse surfaces of which their identification is removably adhered as graphics sheets of suitable matching size. The difficulty of associating products with "A1", "B2", can be eliminated by putting the product names directly on the respective graphics sheets and changing them as needed.

Figure 1:
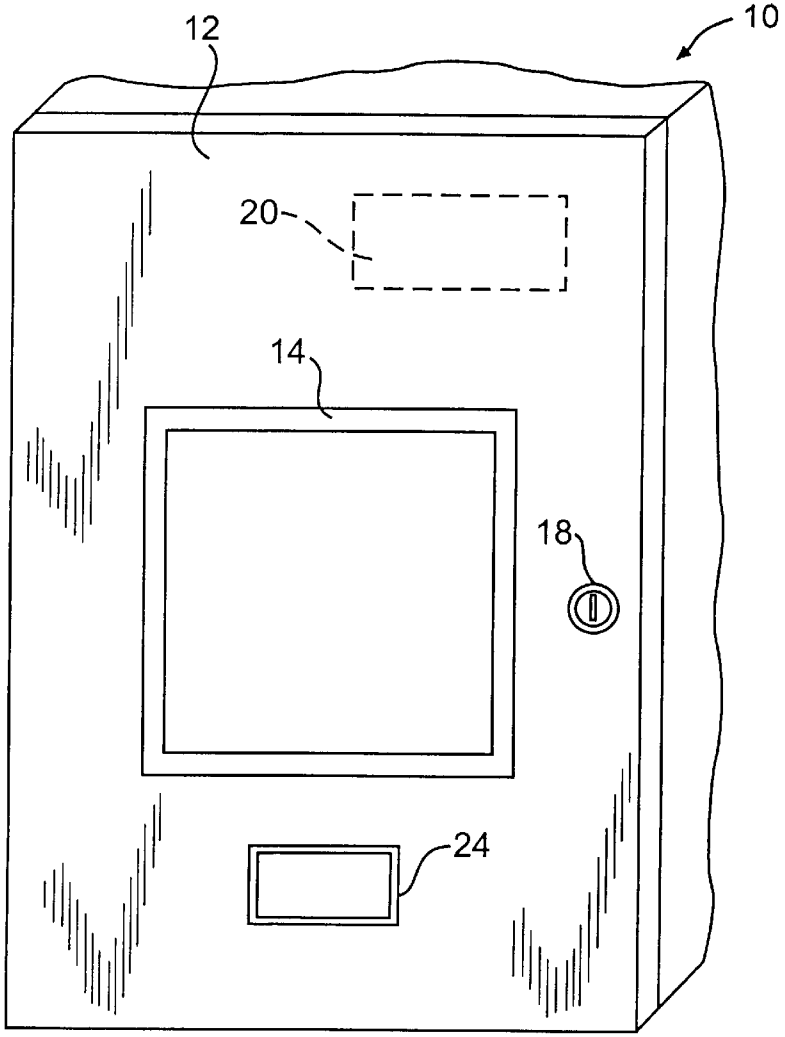
FIG. 1 is a front elevation of a display panel with graphics frame according to the principles of the invention.

As an example of a different embodiment of the apparatus of FIGS. 1 and 4 and the method of FIG. 3, the removable adhering function of the invention is provided by a partial adhesive or reusable adhesive of the type known as a "tacky" adhesive. An example of such an adhesive is that used on POST-IT® brand notes available from Minnesota Mining and Manufacturing Company (3M). POST-IT® is a registered trademark of 3M. Further, the tacky adhesive should be clear and not leave a residue on the display surface. Illustratively, the tacky adhesive is SPRAY MOUNT® artist's adhesive. SPRAY MOUNT® is a registered trademark of 3M. SPRAY MOUNT® artist's adhesive is available from 3M under catalog number 6065.

Product graphics sheet 16, according to this second embodiment of the method of the invention, is illustratively a paper sheet bearing the advertising or marketing graphics. The tacky adhesive is applied in one of the following manners:

(1) over the entire front surface of product graphics sheet 16;

(2) on the edges of the front surface of product graphics sheet 16;

(3) over the entire portion of the reverse surface of panel 12 within the graphics frame 14; or (4) on the edges of the portion of the reverse surface of panel 12 within the graphics frame 14.

Further, because a tacky adhesive is less tolerant of sliding contact than is a static cling contact mediated by a solution such as a soapy solution, the liquid application step 32 and smoothing step 36 may be eliminated. However, in such a case, it is desirable that product graphics sheet 16 in the second embodiment have an overlap of the inner edges of graphics frame 14 to accommodate slight off-center positioning.

The use of cut-outs and inserts according to the invention is further illustrated in FIG. 6 and FIGS. 7A–7C.

Figure 6:
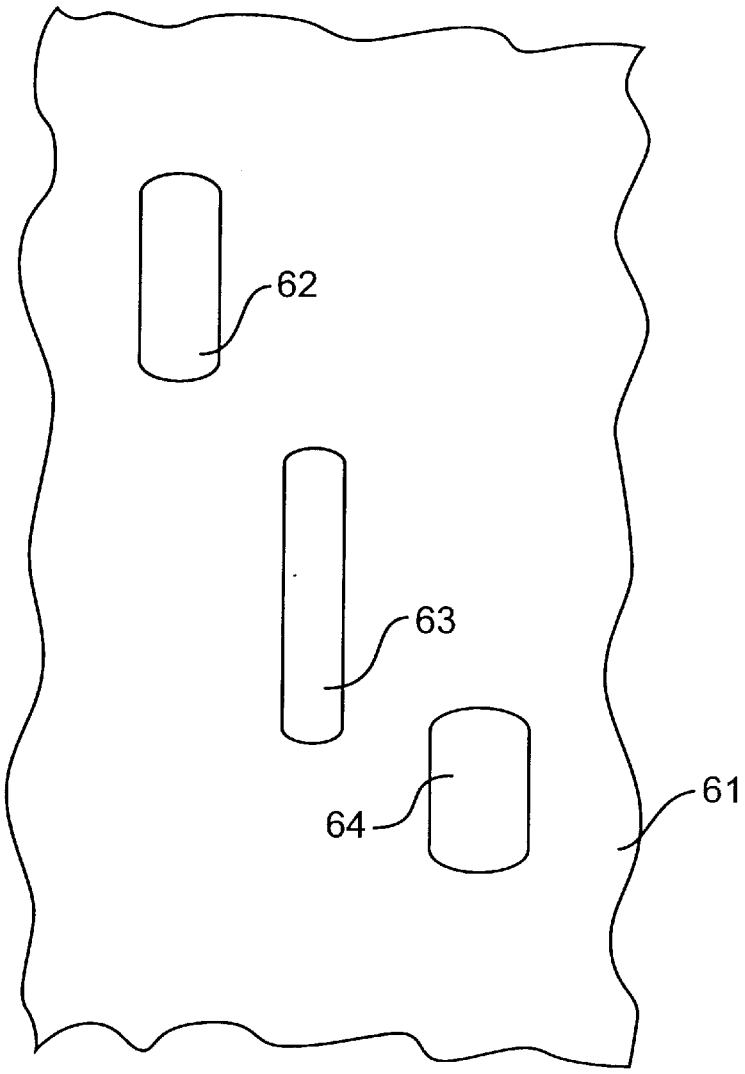
FIG. 6 shows a flexible product graphics sheet with cut-out areas.
Figure 7A:
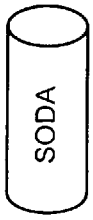
FIGS. 7A–7C show static cling inserts for the respective cut-out areas of FIG. 6.
Figure 7B:
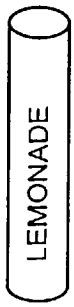
Figure 7C:
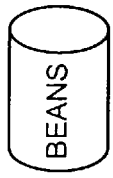

In FIG. 6, the graphics sheet 61, which may be adhered to the inside or reverse surface of a clear display panel, as in the described embodiments, includes cut-out areas 62, 63, and 64. din. each case, an insert 72, 73, or 74, respectively, as illustrated in FIGS. 7A–7C, respectively, provides a shape matching that of the respective cut-out area in FIG. 6, but may from time to time have differing colors, logos, and information thereon, e.g., 'soda', 'lemonade', and 'beans'.

In the vendor embodiments of the invention, the product selection buttons, or 'touch' selection areas, may employ a clear plastic element on the reverse side of which the appropriate labeling employing a static cling material is removably adhered by static cling. Examples of touch selection-type vendors that can be modified in this manner can be found in U.S. Patents Des. 290,272 and Des. 290,271.

It will be apparent to those skilled in the art that various modifications and variations can be made in the arrangement of the present invention and in the associated method without departing from the scope or spirit of the invention. As an example, product graphics frame 14, instead of being semi-permanently screened onto the reverse surface of panel 12 by the technique set out above, may be permanently etched into the reverse surface, or alternatively may itself be applied as one or more static cling elements to the reverse surface of panel 12.

It should also be apparent that the principles of the various embodiments can be combined. For example, it may be advantageous to secure, by a tacky adhesive, one or more corners of a product graphics sheet that has been initially positioned using the method pertaining to static cling.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. Apparatus operatively connected with a product vendor, for graphics display and replacement, comprising:

a clear display panel having front and reverse sides;

means for controlling access to the reverse side of the panel;

a plurality of graphics sheets removably adhered to the reverse side of the panel, at least a first one of said graphics sheets having an area within which a second one of said graphics sheets is positioned;

the first one of said graphic sheets forming a graphics frame with respect to the second one of said graphic sheets, the first one and the second one of said graphic sheets comprising at least one material capable of static cling and clinging to the panel reverse side by static cling; and a second clear display panel and a second plurality of graphics sheets removably adhered to the reverse side of said second clear display panel.

2. Apparatus operatively connected with a product vendor, for graphics display and replacement, comprising:

a clear display panel having front and reverse sides;

means for controlling access to the reverse side of the panel;

a plurality of graphics sheets removably adhered to the reverse side of the panel, at least a first one of said graphics sheets having an area within which a second one of said graphics sheets is positioned;

the first one of said graphic sheets forming a graphics frame with respect to the second one of said graphic sheets, the first one and the second one of said graphic sheets comprising at least one material capable of static cling and clinging to the panel reverse side by static cling; and a plurality of product selection elements, each of said product selection elements including a clear region having a touchable surface and an untouchable surface; and an informational display element removably adhered by static cling to the untouchable surface of said clear region.

3. A method comprising the steps of:

providing on a clear display panel of a point-of-sale device, a protected reverse-side display surface;

providing controlled access to said display surface;

removably adhering by static cling a plurality of elements of clinging sheet material to substantially cover the reverse-side display surface; and selectively removing at least some of said elements and replacing the removed elements, by removably adhering by static cling new elements differing from the removed elements in shape, message, or color to substantially cover the reverse-side display surface and to facilitate sales at said point of sale device;

wherein one of the elements is a graphics sheet and another of the elements is a graphics frame, the graphics sheet being removably adhered within the graphics frame by static cling to the display surface, and the graphics frame being removably adhered by static cling.

4. The method of claim 3, further comprising the steps of:

removing the graphics sheet and the graphics frame by gaining access to said display surface and pulling against the static cling; and removably adhering another graphics sheet and another graphics frame to the display surface within the graphics frame by static cling.

5. The method of claim 4, further including the steps of cutting out areas within at least one of another graphics frame and another graphics sheet, and inserting an element of flexible sheet material with a changed appearance or message within each of the areas cut out.

6. The method of claim 4, including the step of overlaying by static cling separate elements of at least one of the graphics sheet and graphics frame to provide selected effects of color, shape, or message.

7. The method of claim 6, further including the step of changeably backlighting the clear display panel.

8. A method for displaying product graphics, comprising the steps of:

providing on a clear display panel of a point-of-sale device a protected reverse-side display surface;

providing controlled access to said display surface;

removably adhering a plurality of flexible graphics sheets to said reverse-side display surface by static cling, including smoothing the flexible graphics sheets to promote clinging of front surfaces of the flexible graphic sheets to the reverse-side display surface of the clear display panel;

providing for each of the plurality of graphics sheets a plurality of separately adherable elements; and removing and replacing selected ones of said elements to provide a plurality of effects of changeable shape, color, and message, by selected overlap of the adherable elements and by selected cutting out of areas of some of said plurality of graphics sheets and insertion of some of said elements in said cut-out areas, each of said elements clinging by static cling.

9. The method of claim 8, further including separately adherable elements having at least corners removably adhered to the display surface by a tacky adhesive.

10. The method of claim 8, further comprising the step of:

providing changeable backlighting for the protected display surface.

11. A method comprising the steps of:

providing on a clear display panel at a point of sales device a protested reverse-side display surface;

providing controlled access to said display surface;

removably adhering by static cling a plurality of elements of clinging sheet material to substantially cover the reverse-side display surface;

selectively removing at least some of said elements and replacing the removed elements by removably adhering by static cling new elements differing from the removed elements in shape, message, or color to substantially cover the reverse-side display surface and to facilitate sales at said point of sale device; and providing a plurality of said clear display panels each with controllable access to a rear side display surface thereof; and providing respectively noninterfering functions for said plurality of clear display panels.

* * * * *